US005407464A

United States Patent [19]

Kaliski

[11] Patent Number: 5,407,464

[45] Date of Patent: Apr. 18, 1995

[54] ULTRAFINE COMMINUTION OF MINERAL AND ORGANIC POWDERS WITH THE AID OF METAL-CARBIDE MICROSPHERES

[75] Inventor: Adam F. Kaliski, East Windsor, N.J.

[73] Assignee: Industrial Progress, Inc., East Windsor, N.J.

[21] Appl. No.: 179,973

[22] Filed: Jan. 12, 1994

[51] Int. Cl.[6] ..... B02B 5/02

[52] U.S. Cl. ..... 75/746; 241/1; 241/22

[58] Field of Search ..... 241/1, 22; 75/746

[56] References Cited

U.S. PATENT DOCUMENTS 5,033,682 7/1991 Braun ..... 241/22

5,072,886 12/1991 Morrison ..... 241/1

*Primary Examiner*—Peter D. Rosenberg

*Attorney, Agent, or Firm*—Watov & Kipnes

[57] ABSTRACT

The present invention relates to ultrafine comminution of mineral and organic powders with the aid of ball-milling techniques employing, as the grinding medium, solid (nonporous) metal-carbide microspheres with diameters of from 10 to 100 μm fabricated with the aid of high-temperature plasma-torch reactors from fully liquefied carbides of tungsten, thallium, niobium and vanadium.

8 Claims, 1 Drawing Sheet

ULTRAFINE COMMINUTION OF MINERAL AND ORGANIC POWDERS WITH THE AID OF METAL-CARBIDE MICROSPHERES

BACKGROUND OF THE INVENTION

1. Field of the Invention

The present invention relates to superhard metal-carbides, having a Moss hardness of from 9 to 10, made into solid (nonporous) microspheres with diameters of from 10 to 100 μm. The microspheres are fabricated with the aid of high-temperature plasma-torch reactors from fully liquefied carbides of vanadium, niobium, tantalum or tungsten, fed into the torch in the form of a stream of discrete solid particles or mechanically preformed particle aggregates.

More specifically, the invention relates to the comminution of mineral and/or organic powders with the aid of ball-milling techniques employing the above metal-carbide microspheres as the grinding media. The comminuted particles, the coarsest of which are essentially 100%, by weight, finer than 0.9 μm e.s.d. (equivalent spherical diameter) and the finest of which have diameters approaching or reaching 0.002 μm (20 Å), can be obtained in the form of narrow-particle-size-spread, or even nearly monodisperse populations.

2. Discussion of the Relevant Art

U.S. Pat. No. 3,909,241 to Cheney et al. discloses an improved process for a high-temperature plasma-torch agglomeration of finely divided metal powders into substantially spherical, dense particles to impart a free-flowing characteristic to the resultant agglomerate products.

Flame (plasma-torch) spraying techniques are widely used in the art to deposit on various industrial metal objects coatings formed from in-situ-fused metallic or ceramic powders. The function of these coatings is to increase the metal objects' wear and corrosion resistance, improve friction properties or reconstitute worn-out surface regions. The quality of the resultant coatings depends on how uniformly the metallic and ceramic powders are injected into the flame and how uniformly they become distributed within the latter before being deposited onto the target surface. To attain a high degree of uniformity, the fluidized powders must possess adequate free-flowing properties.

Since metallic and ceramic powders with particle diameters of less than 40 μm perform rather unsatisfactorily in flame-spraying applications, it is preferred in the art to employ powders preagglomerated thermally into essentially spherical aggregates (microspheres) having diameters in excess of 40 μm. It is important to point out, however, that plasma-torch agglomeration of metallic or ceramic powders into free-flowing microspheres, as practiced in the art, involves only a partial meltdown (fusion) of the particles fed into plasma-torch reactors. The fused portion of the thermally aggregated feed powders, which is confined essentially to the surface zone of the resultant microspheres, rarely exceeds 40% of the total powder mass. As a matter of fact, a complete plasma-torch meltdown of feed powders into 100%-solid, nonporous microspheres would make their deposition onto the target surfaces, as well as the formation of fused-on coatings, unduly cumbersome if not outright impractical. The reason for this is that fully melted-through, solid microspheres are much denser and require higher flame-spraying temperatures for remelting than the presently used partially melted-through, bulkier (porous) microspheres.

BRIEF DESCRIPTION OF THE DRAWING

A photomicrograph of essentially monodisperse, completely melted-through (solid) tungsten carbide microspheres with diameters of from 50 to 70 μm is shown in FIG. 1. The microspheres were fabricated in accordance with the applicant's design by the GTE division of Sylvania with the aid of a high-temperature plasma-torch reactor. The sporadic occurrence of deviate ellipsoidal formations (instead of the anticipated microspheres) can be clearly recognized in the photomicrograph, the ellipsoids resulting from an incomplete coalescence of colliding liquid drops of tungsten carbide formed in the plasma torch by liquefying a stream of tungsten-carbide feed powder. As is well known from the physics of liquid dispersions in gases, a collision between two spherical drops leads normally to the formation of a single, larger spherical drop by way of a complete coalescence. Since the drops of liquified tungsten carbide exiting from the high-temperature zone of the plasma-torch reactor employed were collected rapidly in a cooling chamber, there was obviously not sufficient time for the coalescing drops to flowout into enlarged drops (microspheres), the resultant deviate formations being simply "frozen" (solidified) in the shape of ellipsoids representing the initial phase of coalescence of two colliding drops. As is readily understood, a sporadic formation of such incidental ellipsoid formations can hardly be avoided when a highly populated stream of fully liquefied drops of metal carbides (or any other liquified media for that matter) rapidly emerges from the high-temperature zone of a plasma-torch reactor to be rapidly cooled in the collecting chamber.

The fundamental difference between the solid microspheres formed by solidification of drops of fully liquefied metal carbides, used in practicing the present invention, and the free-flowing spherical aggregates obtained by a plasma-torch agglomeration of feed powders under conditions of only a partial meltdown practiced in the prior art is best exemplified by the photomicrograph in U.S. Pat. No. 3,909,241 to Cheney et al. As can be readily noticed, deviate ellipsoidal formations, resulting exclusively from an early solidification of incompletely coalesced liquid drops, are totally absent in the latter photomicrograph depicting a polydisperse population of microspheres obtained by passing a molybdenum powder, preagglomerated mechanically (by means of spray drying) into spherical aggregates, through a high-temperature plasma-torch reactor under conditions of only a partial meltdown.

Figure 1:
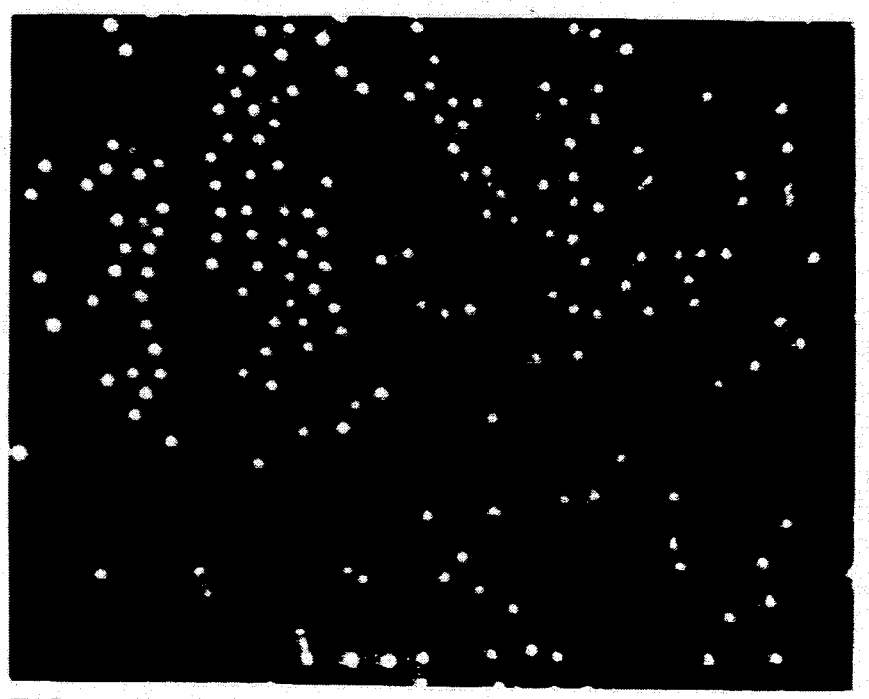

It should also be pointed out that microspheres formed from fully liquefied metal carbides, used in practicing the present invention, are characterized by distinct surface deposits of condensed metal-carbide vapors, which are clearly visible in photomicrographs obtained with the aid of a scanning electron microscope or an optical microscope equipped with a grazing illumination. By contrast, as pointed out in claim 1 of U.S. Pat. No. 3,909,241 to Cheney et al., the partially fused microspheres typical of the prior art are characterized by "substantially smooth nonporous surfaces."

From the standpoint of practicing the present invention, a crucial difference between completely melted-through metal-carbide microspheres and analogous, only partially melted-through microspheres used in the art for depositing fused-on coatings on industrial objects pertains to the relative density of the resultant microsphere products. For example, plasma-torch-made free-flowing microspheres used in the art for flame-spray coating are considered satisfactory when their relative density is not lower than 40% of the theoretical relative density of the material(s) of which they were made. The latter means that microspheres having "substantially smooth nonporous surfaces" and, at the same time, porous, unfused cores are fully suitable for practicing the prior art. In contrast, spherical grinding media with loose (unfused) cores are totally unsuitable for practicing the present invention in that any sporadic breakage of the microspheres would contaminate the comminuted medium with a metal-carbide powder.

The occurrence of such a contamination had been indeed demonstrated by the applicant, who employed partially melted (surface-fused) tungsten-carbide microspheres with a diameter of 800 μm (used in the art for making ball-pen tips) for a rotary-ball-mill comminution of commercial titanium dioxide pigments. The attrition rate of the above microspheres, thus also the level of contamination of the end product, quickly increased from about 0.5 kg per ton of comminuted titanium dioxide, incurred in the initial ball-milling run, to several kilograms per ton, observed after the microspheres were used in about a dozen milling runs. The attrition of the microspheres became even more severe when a quickly vibrating ball mill was used for comminution instead of the above-mentioned relatively slowly rotating ball mill.

It should be also borne in mind that commercial ball-milling operations require, both from the standpoint of comminution efficiency and the ease of separation of the grinding medium from the comminuted medium, that the relative-density differential between the microspheres employed and the comminuted medium be as high as possible. As is readily understood, the latter is realized by employing solid (nonporous) microspheres having a relative density equal to the theoretical one, formed from completely liquified metal carbides. Of course, the manufacture of completely melted-through metal-carbide microspheres is more expensive than that of only partially fused ones since it requires both significantly higher plasma-torch temperatures (e.g., in the vicinity of 30,000° F. or even higher) as well as significantly lower feed-throughput rates through the plasma-torch reactor.

To the best of the applicant's knowledge, microspheres with diameters of from 10 μm to 100 μm, made from fully liquefied metal carbides, have never been manufactured in the prior art. Accordingly, to the best of the applicant's knowledge, such microspheres have never been applied in the prior art to the comminution, let alone ultrafine comminution (beyond the limits of comminution practiced in the art), of mineral and/or organic powders. As a matter of fact, the smallest conventional (ceramic or metallic) microspheres ever reported to be used in ball-milling comminution of mineral or organic powders had diameters of about 200 μm. Due to only moderately high relative density of ceramic and stainless-steel microspheres, ranging from about 2.5–5 g/cm$^3$ for the former to slightly more than 8 g/cm$^3$ for the latter, and a Moss hardness rarely approaching, let alone exceeding, 8, conventional microspheres used in the art as the grinding media in ball-milling processes are obviously inferior to the superhard, dense metal-carbide microspheres used in practicing the present invention.

The importance of employing the smallest practically useful microspheres in ball milling is readily understood from the following free citations from a bulletin issued by Draiswerke, Inc. of Allendale, N.J. (DRAIS NEWS, Vol. 1, No. 3).

According to a mathematical equation provided in the above bulletin, the number of microspheres ($N_s$) occupying a volume of one liter equals $$N_s = 1000 \times d^{-3} \times 0.75^{-\frac{1}{2}} \quad (1)$$

where d = microsphere diameter in cm.

As indicated by the above equation, the number of microspheres in a given volume increases with the third power of the reduction of microsphere diameter. Hence, the number of microspheres occupying a given volume increases, for example, by a factor of 8 when the diameter of the microspheres is reduced by one-half or, analogously, the number of microspheres present in a given volume increases by a factor of 1000 when their diameter is reduced by a factor of 10.

As the number of microspheres occupying a given volume increases, so do the chances of collision between adjacent microspheres, each of these collisions potentially contributing to the comminution of the particulate medium present in the grinding chamber. Since, theoretically, a random packing of microspheres in a grinding chamber corresponds to a rhomboidal pattern, each of the microspheres is surrounded by eight neighboring microspheres. Accordingly, the number of potential collisions between microspheres, designated as $N_c$, is equal to $4N_s$ the equation (1), shown above, being transformed (after some simplifications) into the following one:

$$N_c = 4619 \times d^{-3} \quad (2)$$

In the following, the numbers of potential collisions between microspheres packed rhomboidally in a grinding chamber with a volume of one liter has been calculated for a few selected microsphere diameters:

$N_c$ [1000 μm] = 4,619,000 per liter
$N_c$ [200 μm] = 579,700,000 per liter
$N_c$ [100 μm] = 4,619,000,000 per liter
$N_c$ [50 μm] = 37,100,800,000 per liter
$N_c$ [10 μm] = 4,619,000,000,000 per liter The above numbers of potential collisions which, of course, should additionally be multiplied by the number of rotations, shaking strokes or vibrations performed by the ball mill during the course of a comminution run, clearly attest to the enormous comminuting power of the 10–100 μm microspheres used in practicing the present invention. The critical importance of producing the highest possible number of microsphere collisions during the comminution process becomes especially obvious if one considers that, for example, a single particle with a diameter of 2 μm must be split into one billion fragments to be comminuted to a diameter of 0.002 μm.

As is also readily understood, the high relative density and extreme hardness of solid microspheres made from fully liquefied metal carbides, listed below in Table 1, immensely contribute to these microspheres' comminuting efficacy as well as to the ease of their separation from the comminuted medium.

TABLE 1

| Chemical Formula | Moss Hardness | Relative Density g/cm$^3$ | Melting Temp. °C. |
|---|---|---|---|
| $W_2C$ | 9–10 | 16.1 | 3130 |
| WC | 9+ | 15.7 | 3140 |
| TaC | 9+ | 14.5 | 4150 |
| NbC | 9+ | 7.8 | 3770 |
| VC | 9–10 | 5.4 | 2810 |

SUMMARY OF THE INVENTION

The present invention relates to ball-milling processes in which solid metal-carbide microspheres, having diameters ranging from about 10 to 100 μm, are employed toward the comminution of mineral and/or organic powders to particles with diameters of from 0.002 μm (20 Å) to essentially 100%, by weight, finer than 0.9 μm e.s.d. The ball-milling processes in question, to be understood herein and in the discussions to follow in a generic sense, encompass those carried in either a continuous or a batch mode with the aid of devices such as rotary ball mills, attritors (agitated ball mills), vibrating ball mills or pulsating ball mills.

More specifically, the invention relates to ball-milling processes in which the solid, nonporous metal-carbide microspheres used as the grinding media are made with the aid of high-temperature plasma-torch reactors from fully liquefied carbides of vanadium, niobium, tantalum or tungsten.

While the Moss hardness of the latter carbides is listed in chemical literature as ranging from 9 to 10, there are theoretical indications, verified to some extent in the actual grinding runs, that the highly organized (under the influence of surface tension) surface layers of very small microspheres obtained by a solidification of fully liquefied metal carbides are characterized by an even higher Moss hardness than that characteristic of analogous bulk materials.

The grinding efficiency of solid metal-carbide microspheres used in practicing the present invention is amplified by their high relative density which, due to a complete lack of porosity, is always equal to the theoretical one ranging, in the cases of thallium and tungsten carbides (TaC, WC, $W_2C$ and WC/$W_2C$ eutectic), from about 14.5 c/cm$^3$ to 16.1 g/cm$^3$. As is readily understood, microspheres made of vanadium carbide (VC), with a relative density of only 5.4 g/cm$^3$, or niobium carbide (NbC), with a relative density of 7.8 g/cm$^3$) are less preferable for practicing the present invention than the considerably denser carbides of thallium and tungsten. However, the use of vanadium-carbide or niobium-carbide microspheres may be preferred in some specialized applications, for example, when a surface doping of the comminuted particles with the materials in question is desired.

The comminution of mineral and/or organic powders according to the present invention to particle dimensions not attainable in a practically viable manner with prior-art methods can be carried out in either aqueous or nonaqueous media. Though not indispensable in principle, it is preferable for economic reasons that the feeds for advanced comminution be already as fine as can be attained with the aid of less expensive prior-art grinding methods. For example, to obtain a subpigmentary, ultrafine titanium dioxide for UV-screening applications, having particle diameters of from 0.01 to 0.05 μm, it is preferable to use as the feed material commercial titanium dioxide pigments which are already quite fine having particle diameters of from 0.1 to 1.5 μm.

The advanced comminution of mineral and/or organic powders in accordance with the present invention can be carried out in either a single stage or a multistage ("cascade") process. A single-stage comminution is preferable, for example, in such instances in which the desired particle diameters of the comminuted products range from 0.05–0.1 μm to essentially 100%, by weight, finer than 0.9μ e.s.d. A cascade comminution (consisting of two or more stages), on the other hand, is preferable in those instances in which the desired particle diameters of the comminuted medium should range from 0.002 μm (20 Å) to essentially 100%, by weight, finer than 0.05–0.1 μm, or when it is desirable that the resultant comminuted-particle populations have a narrow particle-size distribution or even are nearly monodisperse.

The preferred grinding media for practicing a single-stage comminution in accordance with the present invention are tungsten-carbide microspheres with diameters ranging from 50 to 100 μm or, yet more preferably, from 50 to 70 μm. In a cascade comminution process, however, it is beneficial to employ progressively smaller microspheres with each consecutive comminution stage.

In general, the practical limits for the dimensions of the diameters of metal-carbide microspheres employed in multistage (cascade) comminution processes should be assessed with the aid of experimental ladders for each individual comminution stage and for each particular material to be comminuted. This can be accomplished, for example, by plotting the dimensions of the actual particle diameters of the comminuted particles as a function of the duration of comminution (at a constant rate of grinding-energy input) or as a function of energy consumption (e.g., in terms of KWH of energy expended per ton of comminuted feed). As soon as the efficiency of comminution decreases below a practically acceptable limit, indicated by the leveling of the descending slopes of the curves in the above-mentioned plots, the need for terminating the present comminution stage and switching to the next one, employing smaller microspheres as the grinding medium, becomes readily apparent.

In practice, however, a reasonable compromise must usually be drawn between selecting the most favorable microsphere dimensions for each subsequent grinding stage from the standpoint of grinding efficiency, and between selecting the most favorable microsphere dimensions from the standpoint of the ease of microsphere separation from the comminuted medium. The present experience indicates that metal-carbide microspheres with diameters of from about 50 to 70+ μm, which are easy to separate from the comminuted medium with the aid of conventional industrial 325-mesh (44 μm) screens, are preferable for both a single-stage comminution process as well as for the first stage of a cascade comminution process. For the second comminution stage, on the other hand, it is usually preferable to employ microspheres which pass completely through a 325-mesh screen and are retained completely on a 500-mesh (25 μm) screen or on yet even finer 625-mesh (15 μm) screen. The still finer microspheres, to be employed in the third and subsequent stages of a cascade comminution process, are best separated from the comminuted medium with the aid of centrifugation and other nonmembrane separation methods.

DESCRIPTION OF THE PREFERRED EMBODIMENTS

In a preferred embodiment of the present invention, particulate titanium dioxide materials, such as pigments, are comminuted further, beyond the limits of practical feasibility of prior-art comminution technologies, to render the end products effective UV absorbers for use in sun-screen preparations. Since absorption of ultraviolet radiation by particles of matter occurs on a molecular level, the dimensions of the comminuted particles should optimally approach those of crystalloids, i.e., 10 Å. For most practical purposes, however, titanium dioxide particles with diameters finer than 0.1 μm, preferably finer than 0.05 μm, are considered as satisfactory UV absorbers.

The following example, in which a commercial $TiO_2$ pigment, essentially 100%, by weight, finer than 1.5 μm in diameter and having an average particle diameter of 0.3 μm was used as the comminution feed, demonstrates the efficacy of the comminution method of the present invention employing solid tungsten-carbide microspheres with diameters of from 50 to 70 μm. The microspheres in question, fabricated in accordance with the applicant's design by GTE (Division of Sylvania), were made with the aid of a plasma-torch reactor from a fully liquefied tungsten carbide powder.

EXAMPLE I

A 60 %-solids slurry of a commercial $TiO_2$ (rutile) pigment, in the amount of 25 g, was loaded into a thick-wall impact resistant plastic canister with a capacity of about 40 $cm^3$ along with 50 g of tungsten-carbide microspheres with diameters of from 50 to 70 μm. The canister was mounted in a laboratory shaker equipped with a shaking-frequency controller.

The canister was shaken at a frequency of about 180 strokes per minute for 20 minutes, after which the tungsten-carbide microspheres were separated from the comminuted medium with the aid of a 325-mesh screen. A subsequent ultramicroscopical evaluation of an appropriately diluted drop-size sample of the slurry of the comminuted titanium dioxide revealed a complete absence of particles larger than about 0.05 μm in diameter.

The efficiency of a follow-up (second-stage) comminution is demonstrated in the following example:

EXAMPLE II

The aqueous slurry of comminuted titanium-dioxide resulting from Example I was loaded into the same plastic canister along with 50 g tungsten-carbide microspheres with diameters of from 10 to 20 μm. The canister was shaken for 30 minutes at a frequency of about 240 strokes per minute.

A subsequent ultramicroscopical evaluation of an appropriately diluted sample of the resultant slurry revealed a complete absence of titanium-dioxide particles larger than 0.01 μm in diameter.

With both above examples, the tungsten-carbide microspheres were carefully weighed before and after the comminution runs. While the attrition of the microspheres (loss of microsphere mass) was established to be in the milligram range, it is anticipated that in commercial-scale grinding runs the attrition could reach 100 to 200 g per ton of titanium dioxide comminuted with the 50 to 70 μm microspheres, used in Example I, and be even lower with the 10 to 20 μm microspheres, used in Example II.

The comminution of a commercial titanium dioxide pigment from Example I was repeatedly verified under quantitative, precisely controlled pilot-plant conditions at the facilities of Draiswerke, Inc. in Allendale, N.J. The equipment employed for comminution was Draiswerke's proprietary Pearl-Mill equipment loaded with solid tungsten-carbide microspheres provided by the applicant.

In all above pilot-plant runs, the comminution of titanium dioxide pigment to particles of from 0.01 to 0.05 μm, in diameter, was attained at an energy consumption of about 120 KWH per ton of titanium dioxide. Assuming the price of electrical energy to be $ 0.05–0.1/KWH, the actual cost of the electric energy consumed by the comminution run is equal to $ 6.00–12.00 per ton of the comminuted product.

In a radical contrast, ultrafine titanium dioxide products of identical particle dimensions are currently being manufactured by way of sophisticated and cumbersome thermochemical processes, which makes these products extremely expensive. Some of the most advanced ultrafine titanium-dioxide products, having particles of from 0.01 to 0.05 μm in diameter, are manufactured by Idemitsu Kosan Co., Ltd. (Japan). The highly diversified applications of the above ultrafine titanium dioxide products encompass, according to Idemitsu's product bulletin, cosmetics, coating materials, polymer additives, absorbents, catalysts and catalyst carriers, single crystals, display materials and electronic devices.

In another preferred embodiment of the present invention, a chemically unbeneficiated (colored) rutile pigment is converted into an unusually highly opacifying pigment by a single-stage comminution to particles essentially 100%, by weight, finer than 0.9 μm e.s.d., or, more preferably, to particles 100%, by weight, finer than 0.6 μm e.s.d., using tungsten-carbide microspheres with diameters of from 50 to 70 μm.

Considerably coarser pigments of the above type are sold under the name Hitox by the Hitox Corporation of America (Corpus Christi, Tex.). Having an average particle size of 1.5 μm e.s.d. and being 100%, by weight, finer than 15 μm e.s.d., Hitox pigments are claimed to be as opacifying as white titanium-dioxide pigments. The unbeneficiated rutile material used in the example to follow was prepared by the applicant himself by calcining a rutile mineral with an initial average particle size of about 150 μm e.s.d. at 760° C., followed by ring-roller crushing to a particle size essentially 100%, by weight, finer than 25 μm e.s.d. and, subsequently, by fluid-energy milling to a particle size essentially 100%, by weight, finer than 4 μm e.s.d.

EXAMPLE III

The single-stage comminution of the above-mentioned particulate rutile was carried out in the manner described in Example I, except that the duration of the comminution run was 10 minutes.

A determination of the particle-size distribution of the comminuted feed revealed that the latter was essentially 100%, by weight, finer than 0.6 μm e.s.d. and had an average particle size of about 0.2 μm e.s.d.

The resultant rutile slurry from Example III was used to deposit binderless coatings of different basis weight on mylar sheets, a commercial (white) rutile pigment being used in the same fashion as a control. The opacity of the resultant coatings was measured with the aid of a laboratory opacity meter and plotted as a function of the coating weight expressed in terms of grams of coating substance per one square meter of coating substrate.

A virtual total coating opacity, traditionally accepted in the trade as 99.7%, was obtained with the comminuted natural (colored) rutile at a coating weight of only 16 g/m$^2$, while an opacity of only 99.5% was obtained with the white rutile pigment used as the control at an overwhelmingly higher coating weight of 150 g/m$^2$.

The finely comminuted, chemically unbeneficiated rutile powder from Example III was also found to be most suitable as a raw material for the manufacture of white titanium dioxide pigments by way of reducing the iron oxide inside the rutile matrix into elementary iron. The latter reduction can be carried sufficiently rapidly to be considered commercially attractive with the aid of hydrogen employed at a normal pressure and a temperature of only 350° C. The elementary iron can subsequently be removed by a number of chemical approaches, e.g., by reacting it with gaseous chlorine, to convert the iron into iron chloride boiling at a temperature of 324° C.; by reacting the iron with carbon monoxide at a pressure of 100 atm. and a temperature of 150–200° C., to convert it into a volatile iron carbonyl boiling at a temperature of 103° C.; or by dissolving the iron by heating the finely comminuted rutile in an autoclave in the presence of hydrochloric acid.

It should be emphasized that the chemical reactions at the foundation of the above and many other equally feasible rutile-beneficiation approaches are well known from chemical textbooks. However, the latter approaches can acquire a practical significance only if an effective penetration (i.e., a penetration resulting in the desired chemical reaction) of gaseous hydrogen, chlorine, carbon monoxide, or other gaseous or liquid media into the rutile matrix occurs within acceptably short time intervals. For the effective penetration in question to occur within such acceptably short time intervals, however, it is absolutely necessary to employ a rutile comminuted to submicron-size particles, such as the rutile particles from Example III comminuted to a size essentially 100%, by weight, finer than 0.6 μm e.s.d. As is well known to those skilled in the art, though, the comminution approaches known in the prior art are incapable of providing such a fine comminution at a commercially acceptable cost.

In yet another preferred embodiment of the present invention, organic dyes are comminuted to nearly molecular dimensions by way of a three-stage comminution, demonstrated in the example to follow, each of the comminution stages being carried out essentially in the same manner as the comminution described in Example I.

EXAMPLE IV

In the first comminution stage, 30 cm$^3$ of a 40%-solids aqueous slurry of a blue dye, whose particles had an average diameter of about 0.5 μm, was loaded into the previously described plastic canister along with 50 g of tungsten-carbide microspheres with diameters of from 50 to 70 μm. The canister was shaken for 30 minutes at about 200 strokes per minute, the tungsten-carbide microspheres being separated afterwards from the dye slurry with the aid of a 325-mesh screen.

In the second comminution stage, the dye slurry resulting from the first process stage was loaded into the plastic canister along with 50 g of tungsten-carbide microspheres with diameters of from 25 to 40 μm. The canister was shaken for 30 minutes at about 250 strokes per minute, the tungsten-carbide microspheres being separated afterwards with the aid of a 500-mesh screen.

In the third comminution stage, the dye slurry resulting from the second process stage was loaded into the plastic canister along with 50 g of tungsten-carbide microspheres with diameters of from 10 to 20 μm. The canister was shaken for 40 minutes at about 300 strokes per minute, the tungsten-carbide microspheres being separated afterwards from the dye slurry with the aid of a brief centrifugation in a light-duty bench-top centrifuge.

Visual observations of highly diluted samples of slurries of the comminuted dye, prepared by homogenizing 1 μl (1 mm$^3$) of a dye slurry resulting from each process stage in one liter of distilled water, showed that the dye's tinting strength increases with the progressing comminution. Moreover, ultramicroscopical observation of the maximally comminuted dye slurry, resulting from the third process stage, revealed a virtual absence of the Tyndall effect. The lack of the latter effect is, of course, indicative of the fact that the above maximally comminuted dye particles are smaller than the smallest Tyndall-effect-producing colloidal ones, whose lower dimension limit is accepted in the colloid-chemical literature as 5 nm (50 Å).

In still another preferred embodiment of the present invention, a yet more effective comminution of organic dyes can be obtained when the latter are first blended with a commercial (white) rutile pigment and then comminuted with the aid of solid tungsten-carbide microspheres using either a single-stage, two-stage or three-stage comminution regime. As is readily understood, the spherical rutile pigment particles are incomparably harder than any organic dye and, hence, exert an immensely effective grinding action of their own. Considering that the spherical particles of commercial rutile pigments have an average diameter of only about 0.3 μm, the number of potential collisions per one liter of grinding medium, which, according to equation (2), is calculated to be equal to 4,619,000,000,000 for 10 μm microspheres, has to be additionally multiplied by 37,000 at the start of the comminution and by progressively higher numbers as the rutile particles become finer and finer due to their own comminution by tungsten-carbide microspheres.

Although the comminuted dye cannot be separated in a commercially acceptable fashion from the co-comminuted rutile, the above comminution approach is practically valid in that inherent blends of ultrafine (subpigmentary) titanium dioxide and organic dyes are routinely used in modern automotive coatings for providing special optical effects. As a matter of fact, the superior performance properties of the intimately comminuted titanium dioxide/organic dye blends obtained in accordance with the present invention cannot, for all practical purposes, be obtained with analogous blends prepared with the aid of prior-art methods.

As is readily understood by those skilled in the art, countless particulate mineral and synthetic materials, such as zinc oxide, barium sulfate or calcium carbonate, or friable metals, can be as readily comminuted to ultrafine particle dimensions as the titanium dioxide dealt with hereinabove. The resultant ultrafine particulate materials are useful, e.g., in the manufacture of decorative and anticorrosive paints; reinforcing fillers for rubber and plastics; ordered-electron-spin transistors; high-temperature superconductors; recording media; catalysts; photovoltaic elements; and additives to rocket fuels. Moreover, many ultrafinely comminuted metal oxides can also be reduced to valuable ultrafine elementary-metal powders by reacting the former with gaseous hydrogen at elevated pressures and/or temperatures while suspended in appropriate oils or molten salts.

As is also readily understood by those skilled in the art, organic dyes comminuted to extremely fine particle diameters, approaching or even reaching 20 Å (0.002 μm), can be used, for example, in the manufacture of advanced photochemical reagents; supersensitive, ultra-high-resolution photographic and X-ray films; and the like. Moreover, many water-insoluble drugs, antibiotics, hormones, vitamins, enzymes and other medical and biological substances comminuted to particle diameters approaching or reaching 20 Å can be made into extraordinarily stable subcolloidal preparations resistant to flocculation or coagulation, which, for all practical purposes, behave like "true" crystalloid solutions. As a consequence, the specific (functional) activities, as well as the ease of assimilation by living organisms, of the above subcolloidal preparations ("pseudosolutions") of drugs and other biologically active substances are expected to be immensely enhanced.

In view of the large areas of fresh surface generated continuously during the ultrafine comminution of powders in accordance with the present invention under the action of locally (at the impact points) highly concentrated shearing forces, it is justifiably anticipated that diversified mechanochemical reactions can be carried out during the course of comminution of appropriately designed heterodispersions of particulate matter, surface doping of crystalline and amorphous particles being one the simplest of such reactions.

While certain preferred practices and embodiments of the present invention have been set forth in the foregoing specification, it is understood by those skilled in the art that other variations and modifications can be employed within the scope of the teachings of the present invention. The detailed description is, therefore, not to be taken in a limiting sense, and the scope of the present invention is best defined by the claims to follow.

What is claimed is:

1. A process for ultrafine comminution of mineral and organic powders, comprising grinding said mineral and organic powders in a ball-milling device with solid (nonporous) metal-carbide microspheres, having diameters of from 10 μm to 100 μm, as the grinding media.

2. A process according to claim 1, wherein said solid (nonporous) metal-carbide microspheres are selected from the group consisting of microspheres of carbides of tungsten, thallium, niobium and vanadium.

3. A process according to claim 1, wherein said ultrafine comminution of said mineral and organic powders comprises comminution in aqueous media and in nonaqueous media.

4. A process according to claim 1, wherein said ultrafine comminution of said mineral and organic powders comprises a single or multiple comminution stages.

5. A process according to claim 1, wherein said ball-milling device is a rotary ball mill.

6. A process according to claim 1, wherein said ball-milling device is an agitated ball mill (attritor).

7. A process according to claim 1, wherein said ball-milling device is a vibrating ball mill.

8. A process according to claim 1, wherein said ball milling device is pulsating ball mill.

* * * * *